US011224272B2

(12) United States Patent
Bartelme et al.

(10) Patent No.: US 11,224,272 B2
(45) Date of Patent: Jan. 18, 2022

(54) PORTABLE ART CASE

(71) Applicants: Michael James Bartelme, Fort Collins, CO (US); Neil Robert Crawford, Chandler, AZ (US); Dalaine Lin Bartelme, Fort Collins, CO (US)

(72) Inventors: Michael James Bartelme, Fort Collins, CO (US); Neil Robert Crawford, Chandler, AZ (US); Dalaine Lin Bartelme, Fort Collins, CO (US)

(73) Assignee: Colorpockit, LLC, Fort Collins, CO (US)

( * ) Notice: Subject to any disclaimer, the term of this patent is extended or adjusted under 35 U.S.C. 154(b) by 99 days.

(21) Appl. No.: 16/736,774

(22) Filed: Jan. 7, 2020

(65) Prior Publication Data

US 2020/0214412 A1 Jul. 9, 2020

Related U.S. Application Data

(60) Provisional application No. 62/790,460, filed on Jan. 9, 2019.

(51) Int. Cl.

| | |
|---|---|
| ***A45C 11/36*** | (2006.01) |
| ***A45C 11/34*** | (2006.01) |
| ***B43L 3/00*** | (2006.01) |
| ***B43L 5/02*** | (2006.01) |
| ***B43L 23/08*** | (2006.01) |

(52) U.S. Cl.

CPC ..... *A45C 11/36* (2013.01); *A45C 11/34* (2013.01); *B43L 3/005* (2013.01); *B43L 5/02* (2013.01); *B43L 23/08* (2013.01)

(58) Field of Classification Search

CPC ..... A45C 11/36; A45C 11/34; B43L 3/005; B43L 5/02; B43L 23/08

USPC ..... 206/1.7, 1.9, 214, 371

See application file for complete search history.

(56) References Cited

U.S. PATENT DOCUMENTS

| | | | | | |
|---|---|---|---|---|---|
| 1,962,988 | A * | 6/1934 | Fulton | A45C 11/36 | 312/231 |
| 3,280,966 | A * | 10/1966 | Boniface | B44D 3/04 | 206/1.7 |
| 3,414,343 | A * | 12/1968 | Thomas | B44D 3/00 | 312/231 |
| 4,372,630 | A * | 2/1983 | Fuhri | A47B 97/08 | 206/1.7 |
| 4,765,457 | A * | 8/1988 | Rayhle | B44D 3/04 | 206/1.5 |
| 5,163,547 | A * | 11/1992 | Hsieh | B44D 3/00 | 206/1.7 |
| 5,860,518 | A * | 1/1999 | Axelrod | A45C 3/02 | 206/224 |
| 7,717,393 | B2 * | 5/2010 | Edgmon | A47B 97/08 | 248/460 |
| 2003/0057110 | A1 * | 3/2003 | Montgomery | B44D 3/04 | 206/1.7 |
| 2004/0060832 | A1 * | 4/2004 | Curry | A45C 11/36 | 206/224 |

(Continued)

*Primary Examiner* — Jacob K Ackun

(57) ABSTRACT

A compact, portable art case is contemplated with (1) an area within the case to store blank sheets for artwork, (2) an exterior surface of the case with a mechanism for holding the artwork in place and serving as a backdrop while coloring, drawing or painting, and (3) a tray interlocking with the case to hold colored pencils or other art supplies necessary to create the art.

14 Claims, 15 Drawing Sheets

(56) References Cited

U.S. PATENT DOCUMENTS

| | | | | |
|---|---|---|---|---|
| 2005/0274631 | A1* | 12/2005 | Martin | B43K 23/001 206/1.7 |
| 2015/0034501 | A1* | 2/2015 | Duffy | A47B 97/04 206/1.7 |
| 2016/0075173 | A1* | 3/2016 | Hutton | B44D 3/02 206/1.7 |
| 2018/0264876 | A1* | 9/2018 | Davis | A47B 97/04 |

* cited by examiner

PORTABLE ART CASE

CROSS-REFERENCE TO RELATED APPLICATIONS

This application claims priority to Provisional Patent Application No. 62/790,460, entitled "Portable coloring system," filed on Jan. 9, 2019, the entire contents of which are incorporated herein by reference.

FIELD OF THE INVENTION

The present disclosure relates to storage and use of coloring, painting, or other art supplies.

BACKGROUND OF THE INVENTION

Currently there are no other art kits intended to be carried with the artist in a purse, bag or backpack that feature coloring cards, card holder/coloring surface, dual-ended pencils and a built-in sharpener. Most coloring books are created independently of the coloring tools and are often not sized for portability or durability in transit. Carrying separate coloring books, pencil sets and sharpeners can be difficult to manage and may lead to damage or items left behind. When smaller form factors are created, they often are reduced sized versions of larger images and are too fine in detail to color with enjoyment or ease. There is a need for a portable, compact art case that simultaneously allows the artist to carry blank or uncolored sheets, serve as a backdrop on which to color, draw or paint one of the sheets, and easily access pencils or crayons of different colors while working on the art.

SUMMARY OF THE INVENTION

A compact, portable art case is contemplated consisting of three main components. The first component is a chamber or drawer within the case to store blank sheets or canvases for artwork. The second component is an appropriately smooth exterior surface of the case to act as a backdrop while coloring, drawing or painting. This region of the exterior of the case may have a mechanism to hold the artwork against the surface while the artist is working on it. The third component is a tray that interlocks with the case to hold colored pencils or other art supplies necessary to create the art. In one embodiment, this tray is a drawer that can be easily accessed without disturbing the work in progress, allowing the artist to change, for example, which colored pencil they are using.

In some embodiments, the art case may also include a built-in sharpener to allow the artist to sharpen their colored pencils or crayons as needed without disturbing the work in progress. In some embodiments, the lid of the case may slide partially open, allowing shavings captured adjacent to the sharpener to be emptied.

BRIEF DESCRIPTION OF THE DRAWINGS

A more complete understanding of the present invention, and the attendant advantages and features thereof, will be more readily understood by reference to the following detailed description when considered in conjunction with the accompanying drawings, wherein.

DETAILED DESCRIPTION OF THE INVENTION

Figure 1:
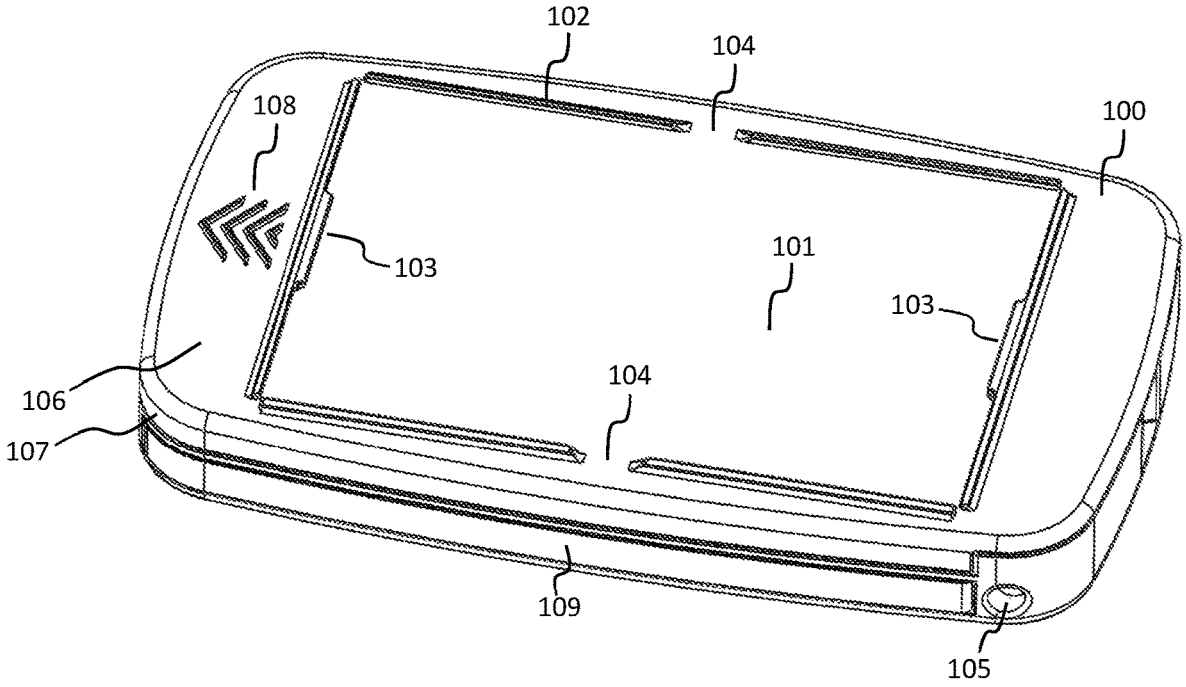
FIG. 1 is an above-side perspective view of one embodiment of the portable art case in a closed configuration.

One feature of the portable art case is an area to store the canvases for the artwork. The word "canvas" could describe a sheet of paper, card, piece of fabric, or other artwork substrate sized to fit within the case when either folded or unfolded. These canvases could be blank or could be imprinted with outlines to be colored or painted, such as pages for coloring. These canvases or pages could be bound together or could be independent sheets or decks.

To access the canvas storage area, a lid may be removed, a door opened, or halves of the case separated. The access portal should not open unless desired or under minimal force such as when carrying it around, and so a feature may hold the canvas storage access portal closed by some mechanism such as a snap closure, a band of flexible material around the outer circumference, a latch, a magnet, a tight frictional interface, a springloaded bumpout and socket, or a toothed ratchet strip that rides over a mating tooth.

Another feature of the portable art case is an appropriately smooth exterior surface of the case to act as a backdrop while coloring, drawing or painting. Appropriate smoothness may be a very flat surface for some uses such as coloring or drawing. In other uses, a sticky surface may be appropriate to hold the canvas. In still other uses, a textured surface may be appropriate if the artist wishes to impart a texture to the artwork through pressure on the canvas when pressing against it with a pencil or brush.

This region of the exterior of the case may have a mechanism to hold the artwork against the surface while the artist is working on it. This mechanism could be a recessed area where the card or canvas nests within the recess and cannot move due to it abutting the wall. Alternately, a raised wall around the work area would enclose the canvas, preventing it from moving. Another mechanism to keep the artwork in place and centered in the work area could be one or more springloaded clips that press the canvas against the work area. Another mechanism is an overhang around part or all of the walled or recessed area, which can prevent the canvas from lifting out of the work area when the case is tilted or moved, or when the artist's hand, brush, or pencil inadvertently pushes it. Such overhangs could be placed at the corners, along edges, or completely around the canvas, and the canvas can be deployed into the work area by slightly flexing it so that it clears the overhangs then releasing it to a flat state.

In conjunction with the work area holder, some embodiments may include a mechanism to release the artwork from the work area holder. One mechanism for releasing the artwork is an indentation or gap to serve as a space for the artist to insert their fingertip, fingernail, or a tool to lift, push or pull the artwork. Another possible mechanism is a springloaded clip that holds the artwork when not pressed but releases and possibly pushes away the artwork when depressed.

A third feature of the art case is a tray that interlocks or encloses within the case to hold colored pencils or other art supplies necessary to create the art. This tray could be a drawer that can slide in and out of the main case. The drawer can be opened and removed from one side only if the drawer opening is enclosed on three sides, or may open bidirectionally if the drawer opening is enclosed only on 2 sides and acts as a pass-through. The drawer may be prevented from opening inadvertently by compliant features that lock into place, such as hemispheres on compliant tabs on the underside of the drawer that settle into sockets on the bottom of the drawer opening. The drawer may be held in place with a toothed ratchet strip that rides over a mating tooth.

In another embodiment, this tray for holding artwork tools could nest inside the box in a fitted cavity. After removing a lid, the tray would be accessible and artwork tools or supplies could be removed or added to the tray, or the entire tray could lift out of the cavity.

Referring now to FIG. 1, in one embodiment of the portable art case 100, the work surface 101 is on the center top of the case, into which a canvas (not shown) would be placed. Raised rails 102 prevent the canvas from moving laterally on the work surface, and overhangs 103 prevent the canvas from moving vertically relative to the work surface. To release the canvas from this enclosed area on the work surface, a gap in the rail 104 allows the artist to insert their fingernail or flat tool under the canvas to lift the canvas.

FIG. 1 also shows an opening 105 into which a pencil may be inserted for sharpening from the side of the art case. The main body of the art case 100 has an upper half 106 and a lower half 107 that slide relative to each other to gain access to the canvas storage area and to empty pencil shavings from the sharpener enclosure. Arrows 108 embossed or printed on the surface of the art case provide a visual cue that the upper half must slide toward the left to open the case. A drawer 109 for storing pencils, crayons, brushes, or other art tools or supplies is accessible from the side, and opens either toward the side visible or the side opposite.

Figure 2:
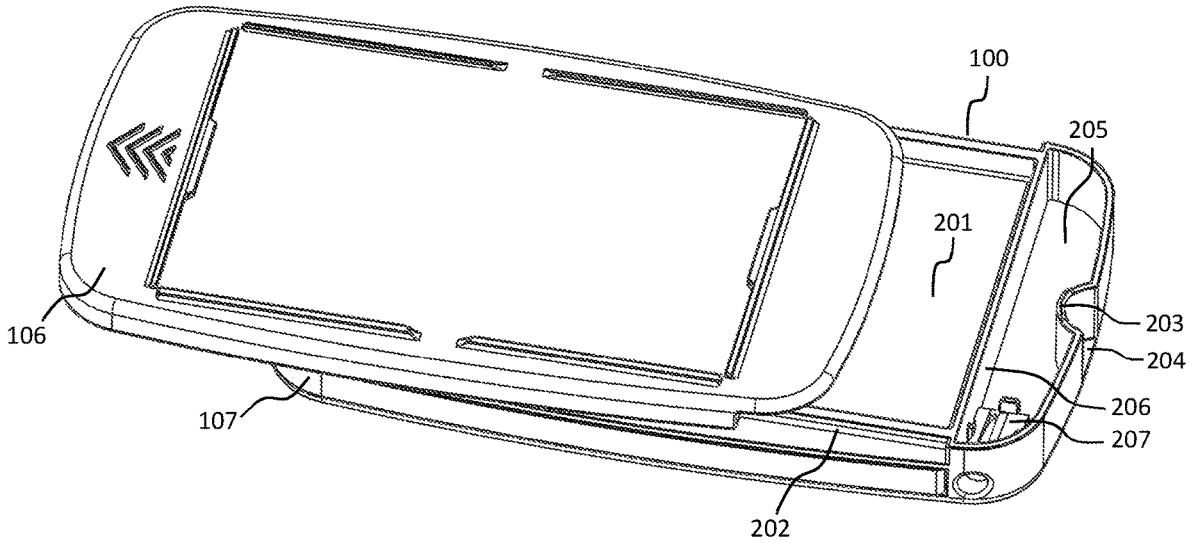
FIG. 2 is an above-side perspective view of one embodiment of the portable art case in an open configuration with upper half slid relative to lower half to reveal canvas storage and shavings compartment.

Referring now to FIG. 2, in one embodiment of the portable art case 100, the canvas storage area 201 is accessible by sliding the upper half 106 of the case 100 along rails 202 on the lower half 107. Movement of the upper case half 106 along these rails 202 is limited by friction and buttressing hard stops (not shown) at the other end of the rail 202. Movement along these rails is also limited by a bumpout 203 that is the highest point of the lower half 107 and presses into a mating divot of the same shape (not shown) on the underside of the top of the upper half 106. When initiating opening of the upper half by pushing with the thumb or finger toward the left, a recessed area 204 allows the thumb or finger to move leftward slightly farther than if the outer wall extended straight across, facilitating opening of the case.

As can also be seen in FIG. 2, in one embodiment, the canvas storage area 201 is adjacent to a sharpener/shavings area 205 and is separated from the sharpener/shavings area by a wall 206. The pencil sharpener 207 is mounted inside this shavings area 205. The shavings area 205 is accessible after sliding upper half 106 to one side relative to lower half 107, allowing the artist to empty the pencil shavings (not shown) that have accumulated in the shavings area 205 as needed.

Figure 3:
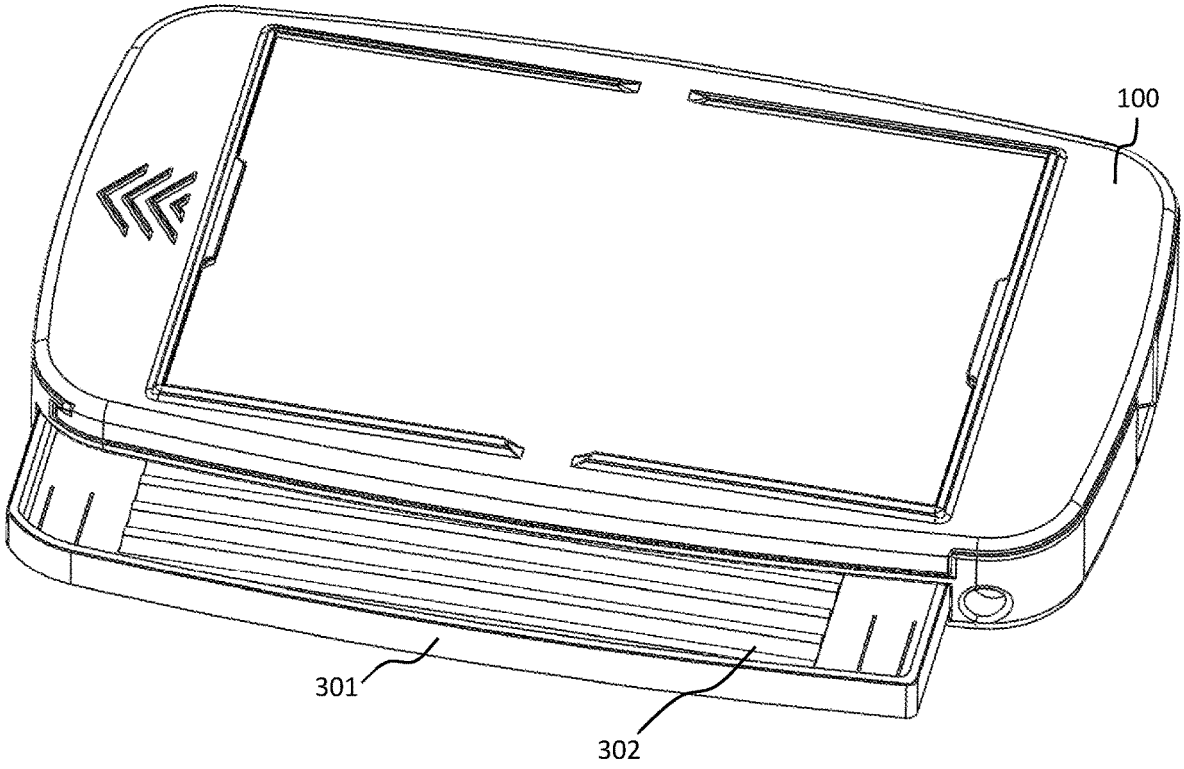
FIG. 3 is an above-side perspective view of one embodiment of the portable art case configured with the pencil drawer partially open.

Referring now to FIG. 3, two-ended pencils or other artwork tools or supplies (not shown) are held in a drawer 301 below the canvas storage area 201. In some embodiments, the drawer may have scalloped or slotted recesses 302 to hold pencils, brushes, or crayons in a parallel arrangement and limit movement of the tools within the drawer during transport.

Figure 4:
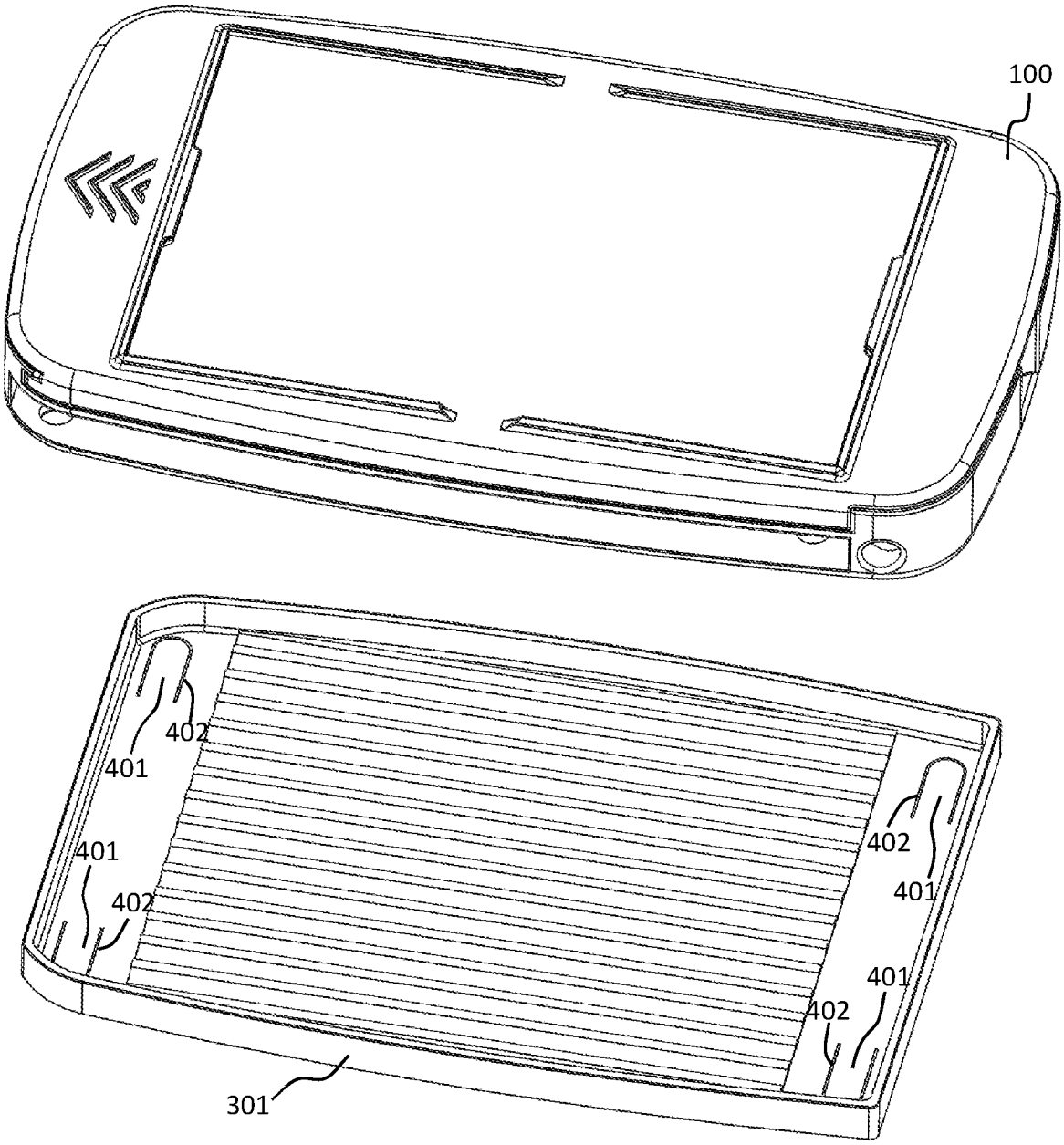
FIG. 4 is an above-side perspective view of one embodiment of the portable art case configured with the pencil drawer removed and placed adjacent to the art case.

Referring now to FIG. 4, in one embodiment, the pencil drawer 301 may, if desired, be completely removed from the art case by pushing and/or pulling it out to either side. With the pencil drawer removed, it can be more easily seen that multiple tabs 401 are cut into the bottom of the pencil drawer. The cuts 402 are elongated to allow the tabs 403 of cut out material that they form to flex at their base.

Figure 5:
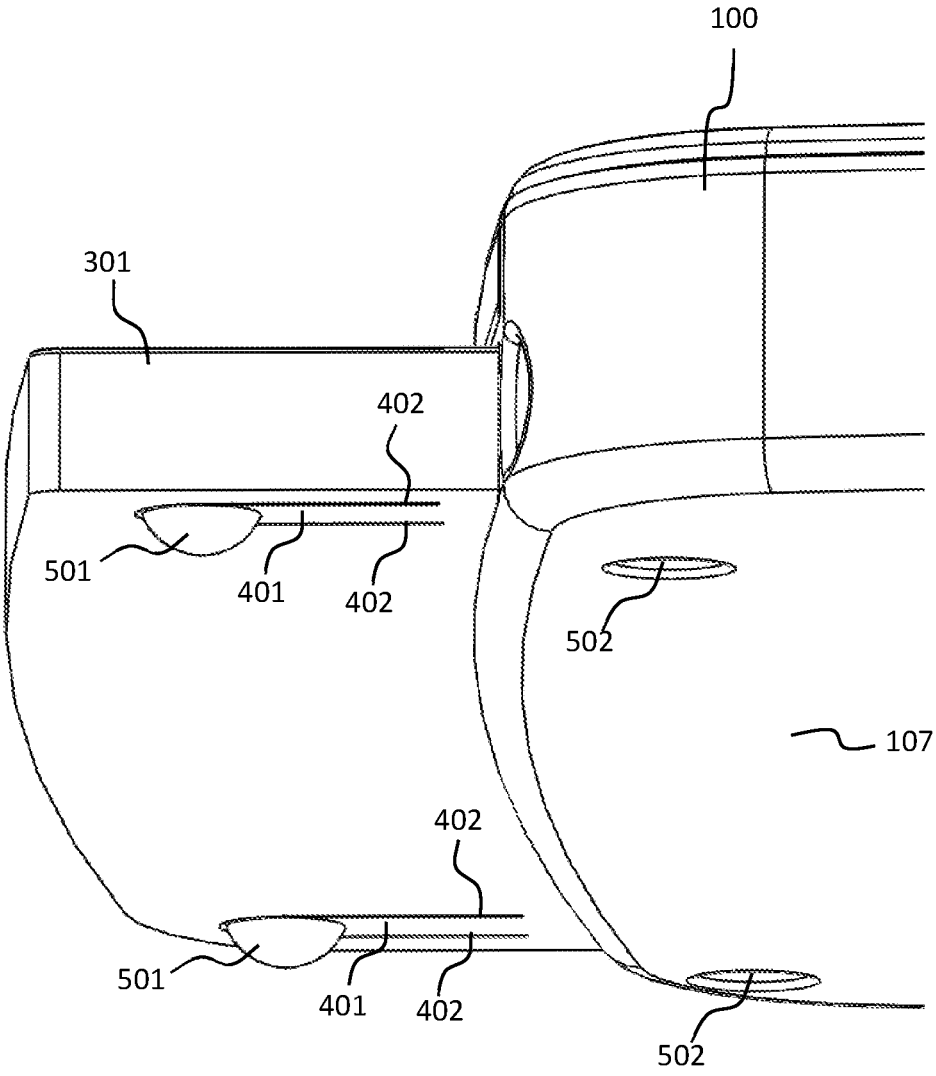
FIG. 5 is a below-side perspective view of one embodiment of the portable art case showing the mechanism for latching the drawer.

Referring now to FIG. 5, in one embodiment, the pencil drawer 301 has on its underside a mechanism where tabs 401 with elevated spherical features 501 act to keep the drawer closed by pressing into a socket or hole 502 in the lower half 107 of the art case 100. The elongated cuts 402 allow the tabs 401 to flex at their bases so that the spherical features 501 ride up over the lower floor of the case after escaping the socket. The tabs 401 with spherical features 501 are present on both sides of the drawer 301 so that it may be opened by pushing it either way but kept closed and centered when all of the features 501 are within their corresponding sockets 502.

Figure 6:
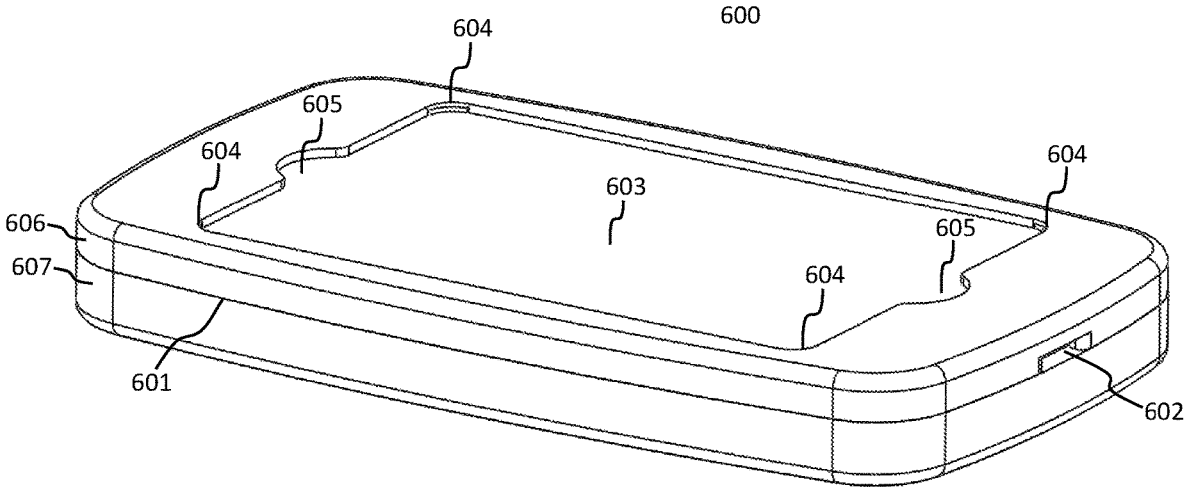
FIG. 6 is an above-side perspective view of one embodiment of the portable art case in a closed configuration.

Referring now to FIG. 6, in one embodiment, the art case 600 opens at a seam 601 between upper half 606 and lower half 607. A relief area 602 on one or both ends allows the artist to insert their thumbnail or a tool to pry the halves apart to gain access to the interior of the case. A rectangular recessed area 603 on the upper half 606 serves as a work area. The rectangular canvas (not shown) is enclosed on 4 sides by this recessed area 603 and cannot move laterally. Overhangs 604 in each corner keep the canvas from lifting out of the work area 603 when the art case 600 is inverted. Semicircular recesses 605 at either end of the work area facilitate the artist inserting their thumbnail or a tool under the canvas to lift it out of the work area 603 when desired.

Figure 7:
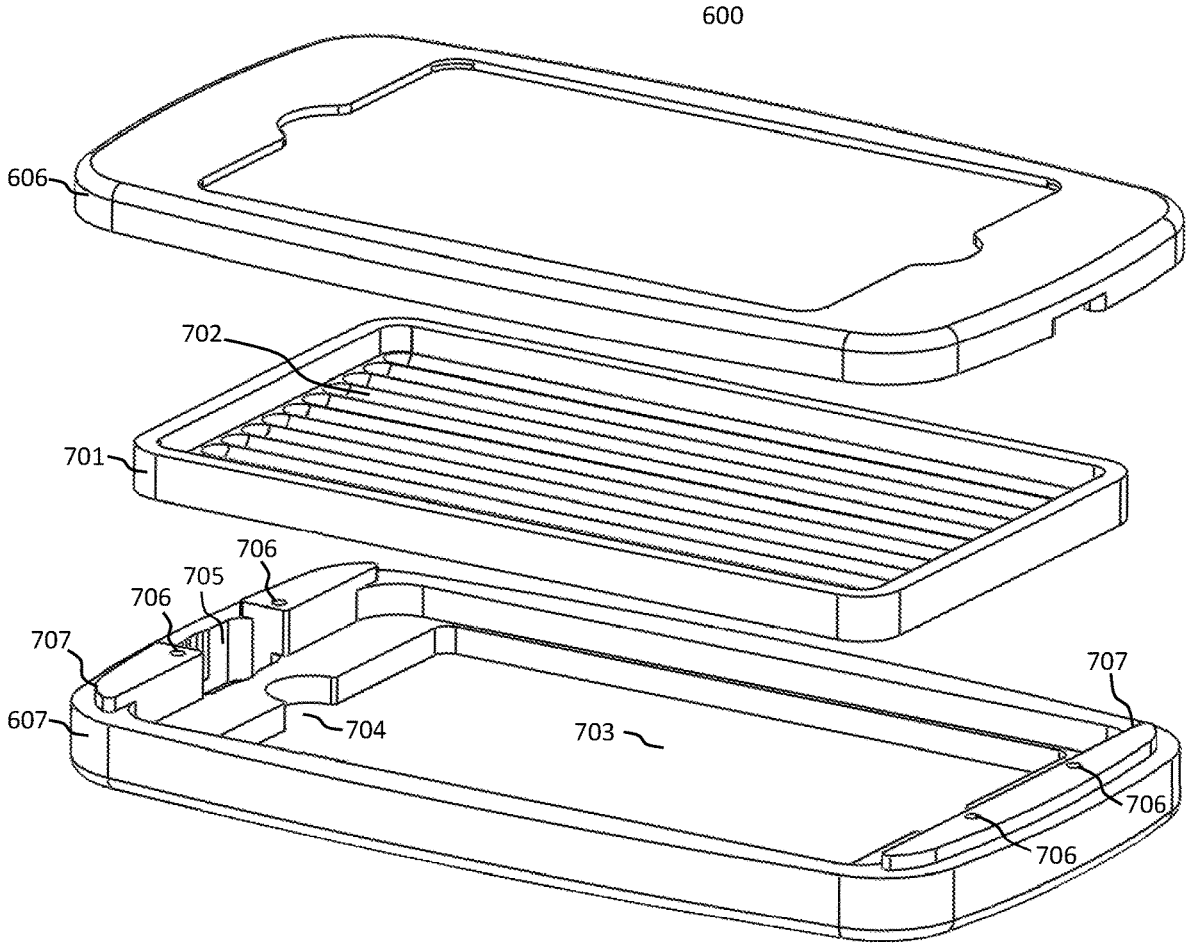
FIG. 7 is an above-side perspective view of one embodiment of the portable art case in an expanded configuration showing the three separate interlocking pieces of the design.

Referring now to FIG. 7, in one embodiment of the art case 600, the upper half 606 and lower half 607 separate, exposing an inner area that contains a drawer 701 for art tools (not shown) such as pencils, brushes, or crayons. The way the halves separate, exposing an inner part that is itself removable is reminiscent of a typical "Bento box." This drawer 701 can lift out of the lower half 607 and the artist can reattach the upper half 606 and place the drawer 701 elsewhere. Or, the drawer 701 can remain in place within the lower half 607 after the user lifts the upper half 606 to retrieve a tool. The drawer 701 in this embodiment has scalloped slots 702 to prevent art tools from rolling or sliding within the drawer during normal use.

As can also be seen in FIG. 7, a recess 703 below the cavity for the pencil drawer 701 is available to store canvases (not shown). At the ends of this cavity, a semicircular divot 704 is present to allow the artist to insert their fingernail or a tool under the canvases to facilitate removal of one or more canvases. A recessed slot 705 is present to store a pencil sharpener (not shown). Magnets inserted in magnet holes 706 help keep the upper half 606 and lower half 607 together when contacted against magnets or metal (not shown) on the underside of the upper half 606 of the art case 600. Raised edges 707 on the top of the lower half 606 mate with recesses (not shown) at the bottom of the underside of the upper half 606 to keep the halves of the art case 600 centered.

Figure 8:
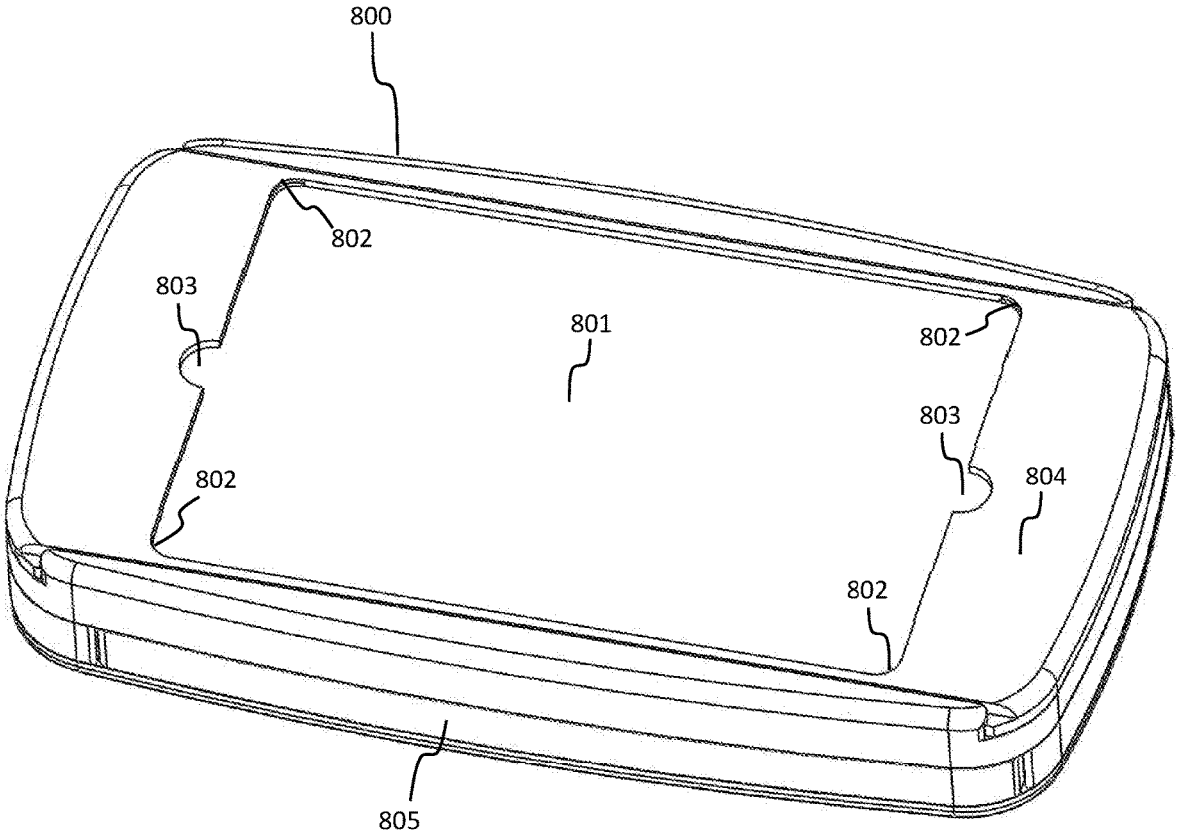
FIG. 8 is an above-side perspective view of one embodiment of the portable art case in a closed configuration.

Referring now to FIG. 8, in another embodiment of the art case 800, a recessed rectangular area 801 in the lid 804 serves as the work area. Overhangs 802 above each corner of the work area keep the canvas (not shown) from lifting out. Divots 803 are available at either end of the work area to facilitate removal of the canvas. The lid 804 of the art case slides toward either end to expose the interior of the art case. A drawer 805 near the bottom of the art case 800 holds pencils, brushes or other art tools (not shown).

Figure 9:
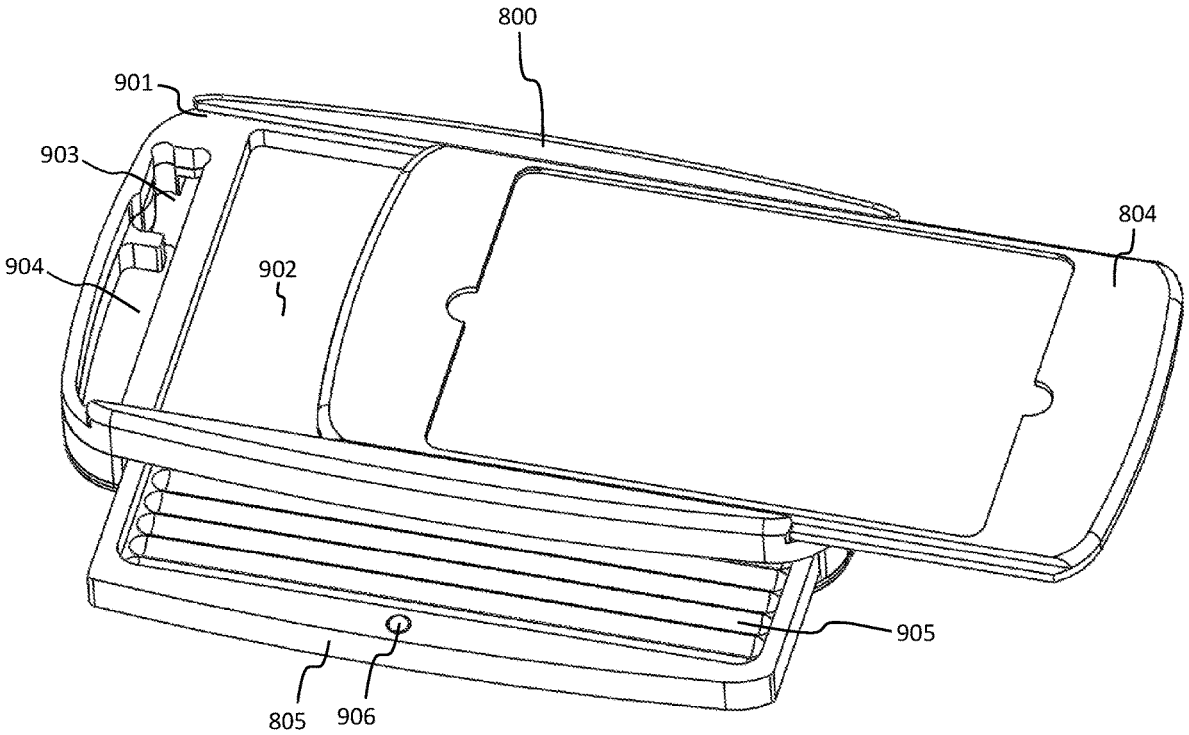
FIG. 9 is an above-side perspective view of one embodiment of the portable art case in an open configuration with upper half slid relative to lower half to reveal canvas storage and shavings compartment.

Referring now to FIG. 9, in an embodiment of the art case 800, the lid 804 slides sideways. Guide slots 901 capture the edges of the lid 804 to serve as a linear bearing on which the lid moves. When slid to the side, the canvas storage area 902, a chamber 903 for the pencil sharpener (not shown) and a space 904 adjacent to the pencil sharpener to keep pencil shavings (not shown) are exposed. A hole (not shown) on the far side of the art case 800 allows a pencil to be inserted into the pencil sharpener that is held in chamber 903 without removing the pencil sharpener from the art case 800. By opening the lid 804 in the direction shown, pencil shavings may be removed from the shavings compartment 904 for disposal; when opened in the opposite direction, canvases may be accessed without exposing the shavings compartment 904.

As can also be seen in FIG. 9, a drawer 805 for holding brushes, pencils, crayons or other art tools (not shown) can be opened either in the direction shown or opposite. The drawer 805 in this embodiment has scallops 905 in the floor to prevent pencils or brushes from rolling or sliding within the drawer during normal use. A magnet 906 inserted in a recess in the edge of the drawer 805 keeps the drawer 805 from inadvertently sliding open when closed due to the magnet 906 contacting another magnet or metal surface (not shown) on the underside of the drawer cavity.

Figure 10:
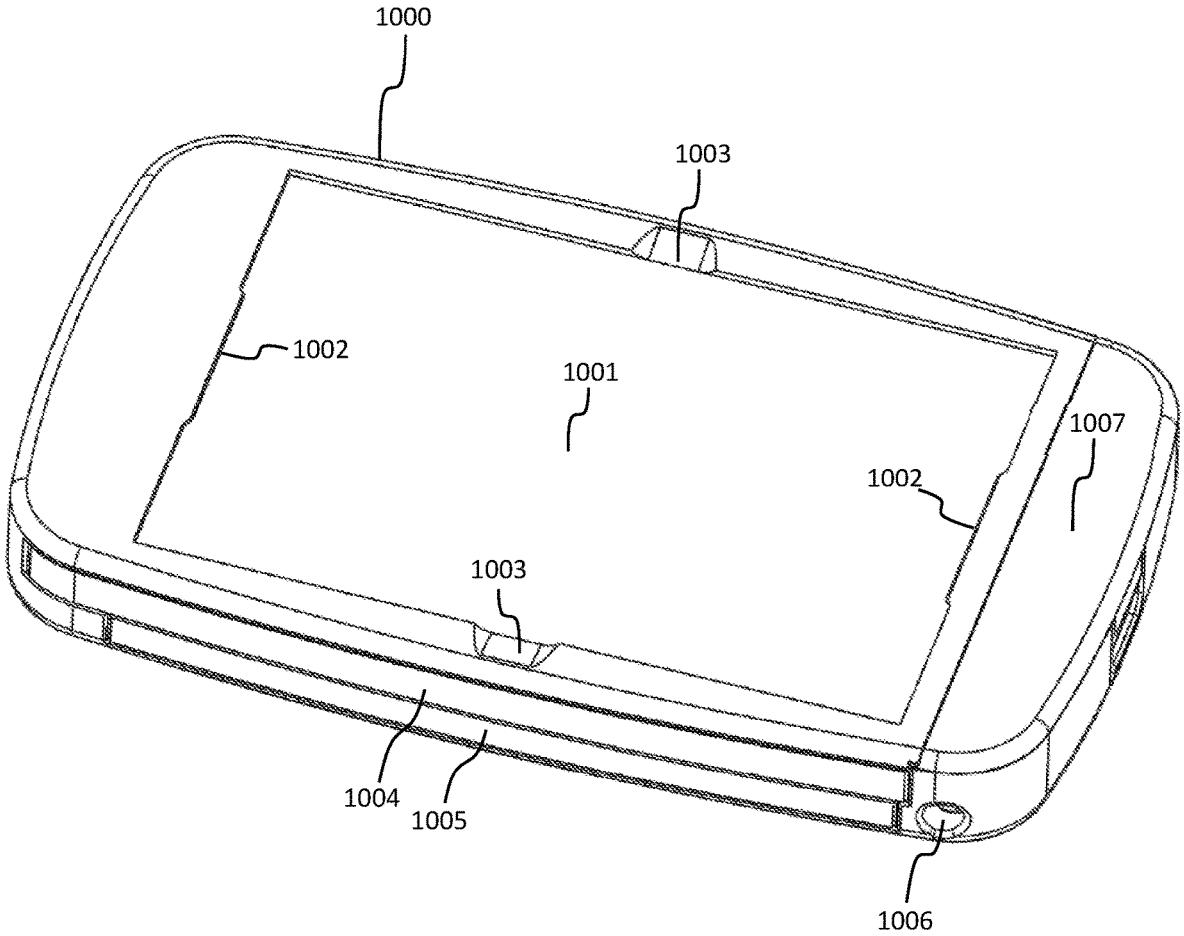
FIG. 10 is an above-side perspective view of one embodiment of the portable art case in a closed configuration.

Referring now to FIG. 10, in another embodiment of the art case 1000, a recessed rectangular area 1001 in the top outer surface of the art case 1000 serves as the work area. Overhangs 1002 above the short edges of the rectangular work area 1001 keep the canvas (not shown) from lifting out. Divots 1003 are available at either long side of the rectangular work area 1001 to facilitate removal of the canvas. A drawer 1004 holds pencils, crayons, brushes or other art tools and a second drawer 1005 holds canvases. A hole 1006 is present in the side of the art case 1000 through which the user may insert a pencil to be sharpened. A lid 1007 may be lifted open to allow access to the pencil sharpener and pencil shaving area.

Figure 11:
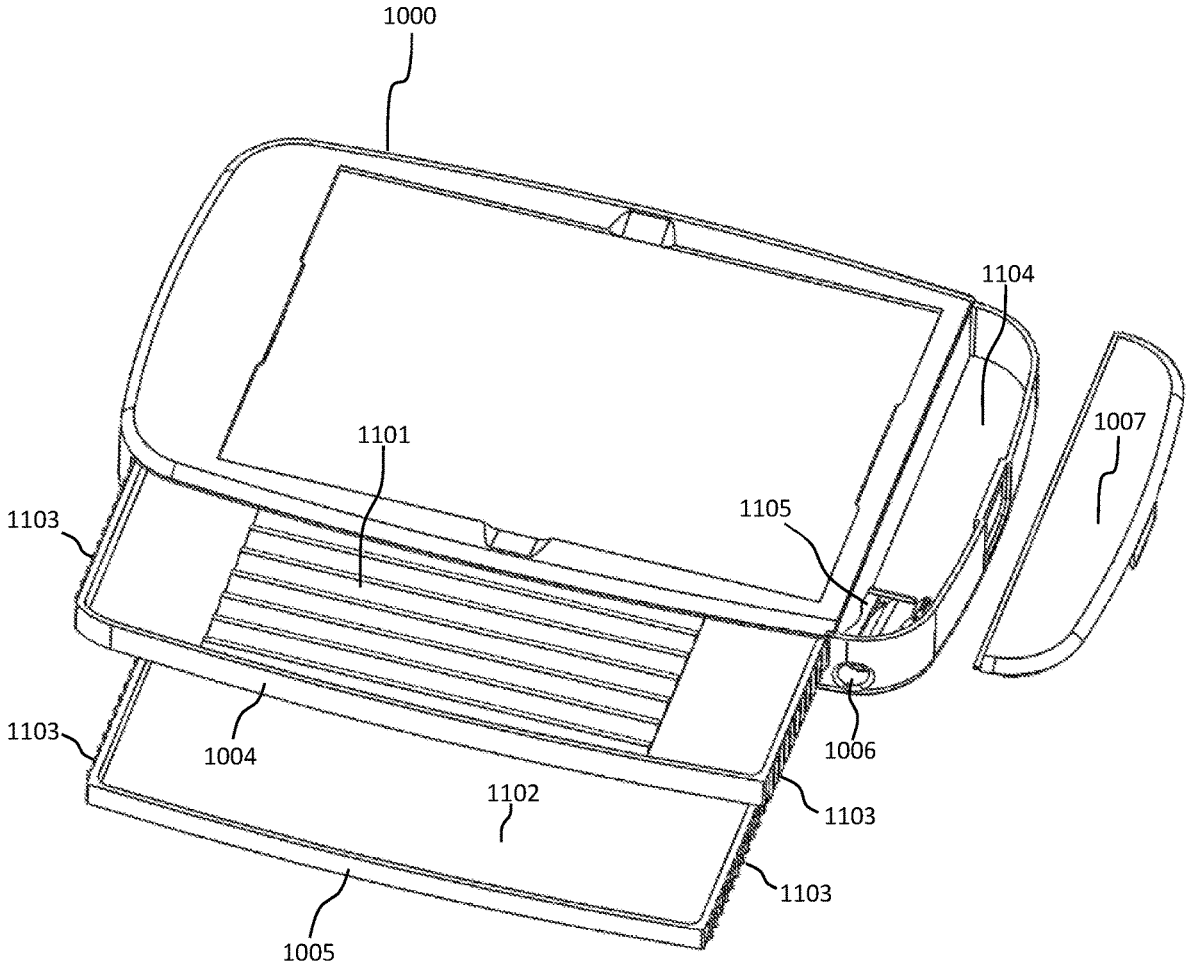
FIG. 11 is an above-side perspective view of one embodiment of the portable art case in an open configuration with upper half slid relative to lower half to reveal canvas storage and shavings compartment.

Referring now to FIG. 11, in an embodiment of the art case 1000, the pencil drawer 1004 opens toward the side shown or toward the opposite side. The bottom of the pencil drawer has scallops 1101 to prevent pencils from rolling or moving during normal usage. Like the pencil drawer 1004, the canvas storage drawer 1005 opens toward the side shown or toward the opposite side. Canvases are stored in the body of this drawer 1102. On the edges of both the pencil drawer 1004 and the canvas storage drawer 1005, a linear pattern of teeth 1103 is present. These teeth 1103 interface with a flexible tooth within each drawer cavity (not shown) to prevent the drawer from sliding open inadvertently. Minimal pressure by pushing or pulling on a drawer overcomes the tooth interaction and allows controlled opening of each drawer.

As can also be seen from FIG. 11, after removing the lid 1007, a compartment 1104 holding a pencil sharpener 1105 is accessible. The remainder of the compartment 1104 holds pencil shavings (not shown) as they are generated from sharpening a pencil through opening 1006. By opening the lid 1007, pencil shavings may be removed from the shavings compartment 1104 for disposal.

Figure 12:
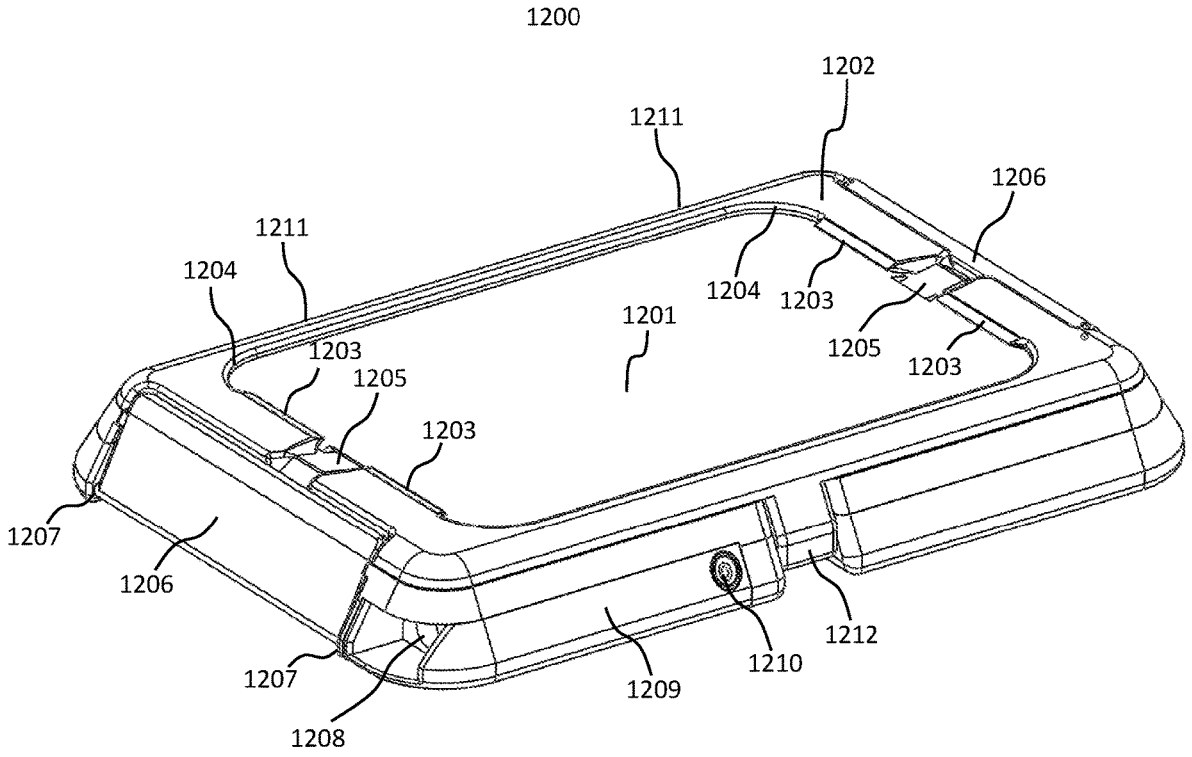
FIG. 12 is an above-side perspective view of one embodiment of the portable art case in a closed configuration.

Referring now to FIG. 12, in another embodiment of the art case 1200, a recessed rectangular area 1201 in the top outer surface 1202 of the art case 1200 serves as the work area. Straight overhangs 1203 above the short edges of the rectangular work area 1201 and curved overhangs 1204 at each corner of the work area 1201 keep the canvas (not shown) from lifting out. Divots 1205 are available centered on the short edges of the work area 1201 to facilitate removal of the canvas. Hinged doors 1206 provide access to the inner area where pencils, crayons, brushes or other art tools are kept. The hinge points 1207 of the doors are located at the bottom of the door. A hole 1208 is present on the end of the art case 1200 through which the user may insert a pencil to be sharpened. A separatable pencil sharpener compartment 1209 locks into the art case 1200. The pencil sharpener compartment 1209 may be detached from the main body of the art case by depressing a release button 1210. The top outer surface 1202 is hinged, with hinge points 1211 located along the long edge of the upper surface 1202. A latch 1212 on the upper surface 1202 is released by pulling outward, allowing access to the canvas storage area inside the art case 1200.

Figure 13:
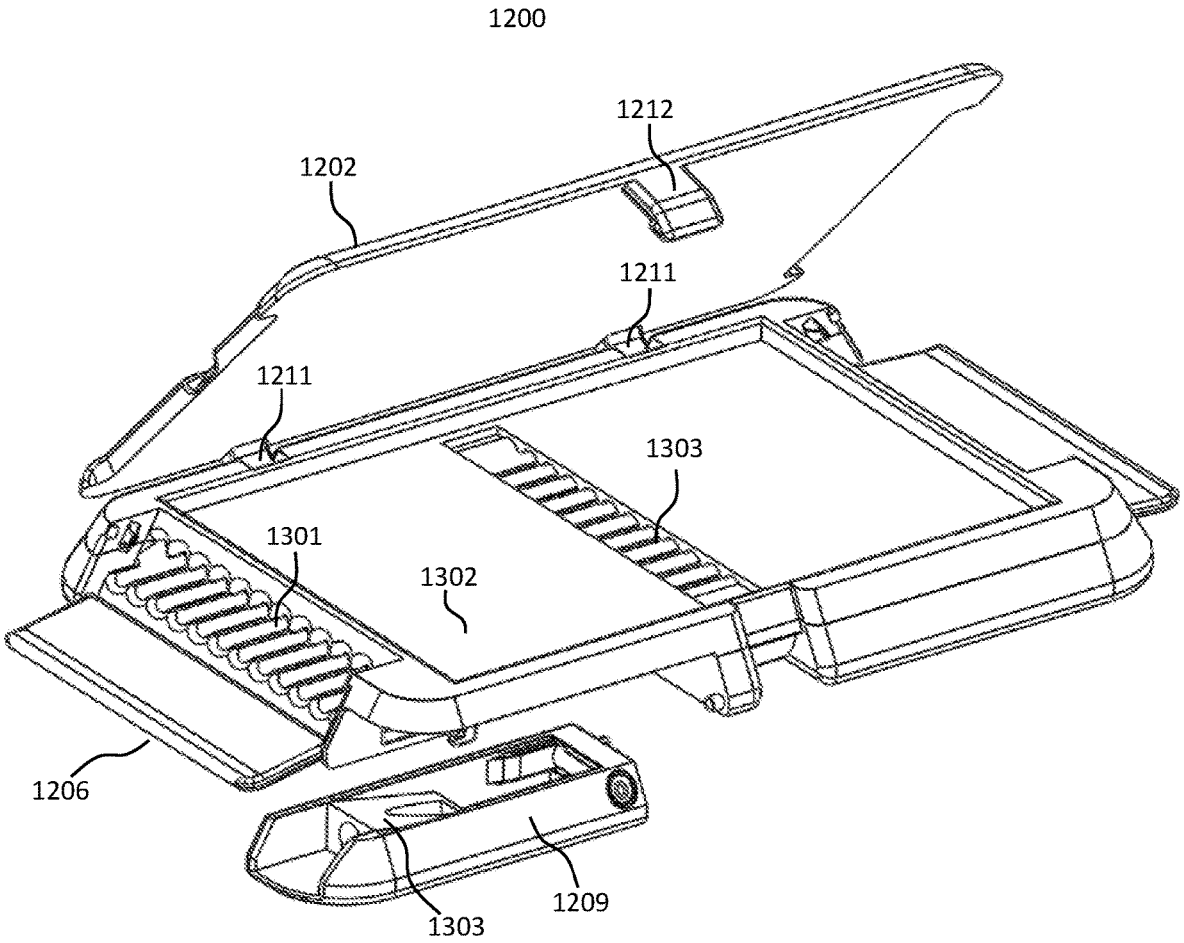
FIG. 13 is an above-side perspective view of one embodiment of the portable art case in an open configuration with upper half slid relative to lower half to reveal canvas storage and shavings compartment.

Referring now to FIG. 13, in an embodiment of the art case 1200, the pencils, crayons, brushes or other art tools (not shown) are stored in slots 1301 accessible by opening hinged doors 1206 at either end of the art case 1200. Slots are arranged in a row so that tools do not roll or move laterally when stored. The top surface 1202 of the art case has hinges 1211 allowing it to open after pulling latch 1212 away from its point of contact. With the top surface 1202 open, the canvas storage area 1302 is accessible. A window 1303 in the center of the canvas storage area 1302 allows the colors of the pencils to be viewed when no canvases are stored and can also be used to dislodge short tools that have migrated to the center and are not easily accessible from the ends. In FIG. 13, the pencil sharpener compartment 1209 can be seen detached from the main body of the art case 1200. With the pencil sharpener compartment 1209 separated, accumulated shavings (not shown) can be emptied. The pencil sharpener 1303 is also visible and can be removed and cleaned or replaced after detaching the pencil sharpener compartment 1209.

Figure 14:
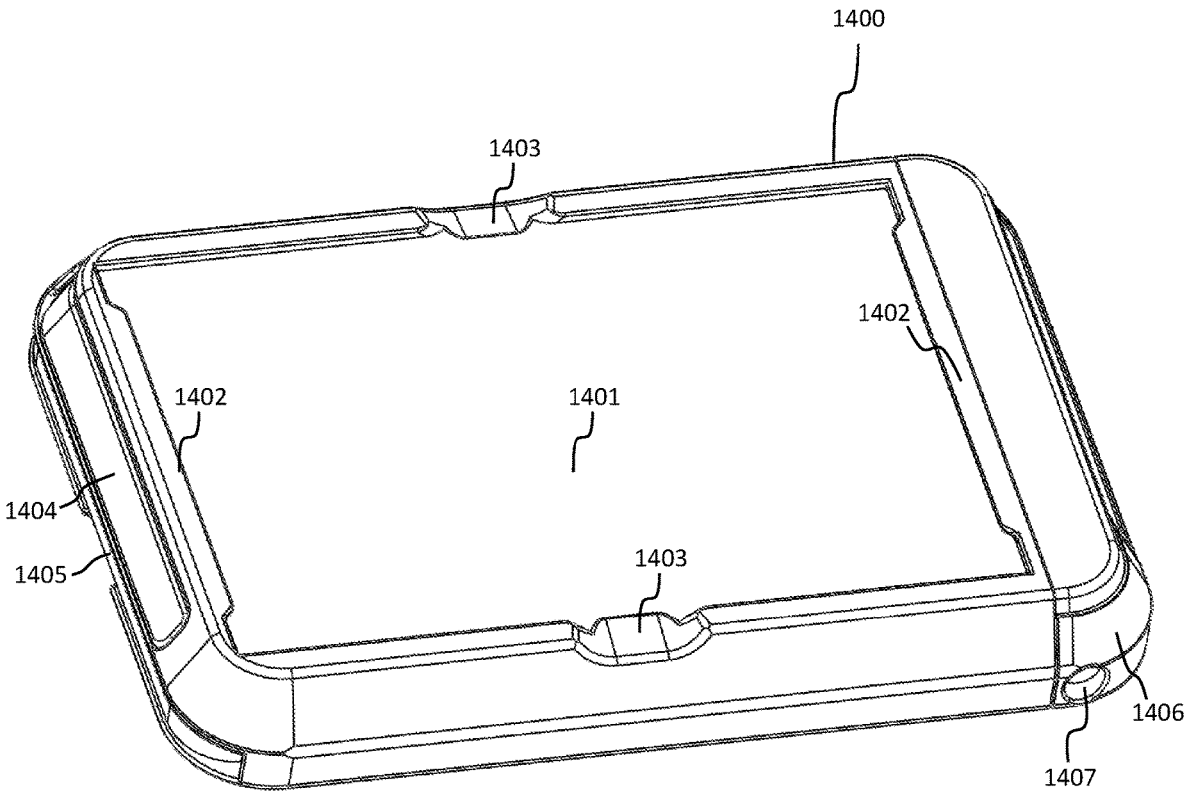
FIG. 14 is an above-side perspective view of one embodiment of the portable art case in a closed configuration.

Referring now to FIG. 14, in another embodiment of the art case 1400, a recessed rectangular area 1401 in the top outer surface of the art case 1400 serves as the work area. Straight overhangs 1402 above the short edges of the rectangular work area 1401 keep the canvas (not shown) from lifting out of the work area during usage. Divots 1403 are available centered on the long edges of the work area 1401 to facilitate removal of the canvas. A drawer 1404 holds pencils, crayons, brushes or other art tools and a second drawer 1405 holds canvases. A separatable pencil sharpener compartment 1406 locks into the art case 1400. A hole 1407 in the pencil sharpener compartment 1406 allows a pencil to be inserted and sharpened. The pencil sharpener compartment 1406 may be detached from the main body of the art case by depressing a release button (not shown) or pulling the pencil sharpener compartment 1406 forward with enough force to dislodge it.

Figure 15:
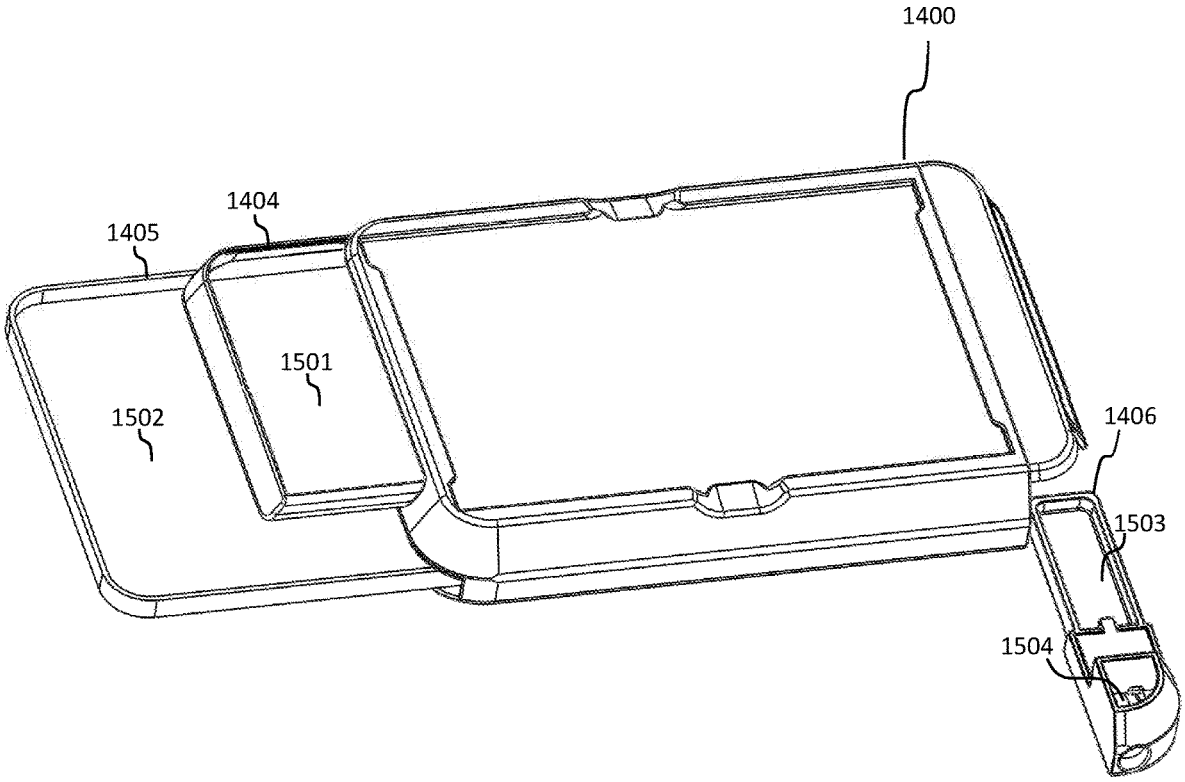
FIG. 15 is an above-side perspective view of one embodiment of the portable art case in an open configuration with upper half slid relative to lower half to reveal canvas storage and shavings compartment.

Referring now to FIG. 15, in an embodiment of the art case 1400, the pencils, crayons, brushes or other art tools (not shown) are stored in area 1501 within drawer 1404. Canvases (not shown) are stored in the canvas storage area 1502 within drawer 1405, which is wider but shorter than drawer 1404. In FIG. 15, the pencil sharpener compartment 1406 can be seen detached from the main body of the art case 1400. With the pencil sharpener compartment 1406 separated, accumulated shavings (not shown) can be emptied from shavings area 1503. The pencil sharpener 1504 is also visible and can be removed and cleaned or replaced after detaching the pencil sharpener compartment 1406.

One skilled in the art will appreciate that the embodiments discussed above are non-limiting and could apply to art forms other than coloring, drawing, or painting that involve using a set of tools to modify a canvas or other substrate. It will also be appreciated that one or more features of one embodiment may be partially or fully incorporated into one or more other embodiments described herein.

What is claimed is:

1. A portable art case for coloring, drawing, or painting comprising an enclosed area in a lower case half to store a plurality of sheets or canvases for the artwork;

an enclosed area in the lower case half storing an interlocking but removable tray, the tray holding a selection of supplies for performing artwork;

an area in an upper case half on the outer surface of the case to act as a supporting backdrop, with means to center and hold one sheet or canvas, which is the artwork in progress; and the upper case half and the lower case half are slidable relative to each other to gain access to the enclosed area to store a plurality of sheets or canvasses.

2. The system of claim 1, wherein the interlocking tray is a drawer that slides open to allow access to the pencils, crayons, or other art supplies without disturbing the work in progress.

3. The system of claim 2, wherein the drawer slides bidirectionally and has a centering mechanism to prevent it from sliding open unintentionally.

4. The system of claim 1, wherein the enclosed area to store a plurality of sheets or canvases is accessed by sliding the supporting backdrop surface to one side.

5. The system of claim 1, wherein a built-in sharpener for pencils or crayons is also enclosed by the case and accessible through a hole in the case, and is adjacent to a shavings compartment.

6. The system of claim 1, wherein a cavity sized to fit a removable pencil sharpener is enclosed by the case.

7. The system of claim 1, wherein the means to center and hold the artwork includes a walled area with overhanging tabs to prevent the canvas from moving.

8. The system of claim 1, wherein the selection of art supplies held by the interlocking tray is pencils, pens, or crayons of different colors.

9. The system of claim 1, wherein the selection of art supplies held by the interlocking tray is one or more brushes, one or more paint-mixing wells, and one or more tubes or blocks of paints.

10. The system of claim 1, wherein the case is fabricated from wood.

11. The system of claim 1, wherein the case is fabricated from plastic.

12. The system of claim 1, wherein the case is fabricated from sheet metal.

13. The system of claim 1, wherein the interior of the case is accessed by sliding the artwork backdrop surface to one side on rails that have detented friction stops to prevent the case from opening unintentionally.

14. The system of claim 1, wherein the access portal to the case is prevented from opening unintentionally by earth magnets on opposite surfaces.

* * * * *